US006317933B1

(12) United States Patent
Suenaga

(10) Patent No.: US 6,317,933 B1
(45) Date of Patent: Nov. 20, 2001

(54) BINDING BAND

(75) Inventor: Tomohiro Suenaga, Nara-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/473,805

(22) Filed: Dec. 28, 1999

(30) Foreign Application Priority Data

Jan. 14, 1999 (JP) ..... 11-008201

(51) Int. Cl.[7] ..... B65D 63/10
(52) U.S. Cl. ..... 24/16 R; 24/442
(58) Field of Search ..... 24/16 R, 16 PB, 24/17 A, 17 AP, 306, 446, 442, 30.5 P; 128/DIG. 15; 224/901.4; 248/74.3

(56) References Cited

U.S. PATENT DOCUMENTS 3,977,393 * 8/1976 Kovacic .
4,215,687 * 8/1980 Shaw .
4,617,017 * 10/1986 Hubbard et al. .
4,963,410 10/1990 Bryant .
5,048,158 9/1991 Koerner .
5,167,050 * 12/1992 Korsen .
5,168,603 12/1992 Reed .
5,515,583 * 5/1996 Higashinaka .
5,520,656 * 5/1996 Byrd .
5,659,930 * 8/1997 Okawa .
5,802,676 9/1998 Tolan .

FOREIGN PATENT DOCUMENTS 196 20 681 11/1997 (DE) .

* cited by examiner

*Primary Examiner*—James R. Bittain
(74) *Attorney, Agent, or Firm*—Finnegan, Henderson, Farabow, Garrett & Dunner, L.LP.

(57) ABSTRACT

There is disclosed a securely fitting binding band in which production thereof is easy with low cost. The binding band comprises a tightening piece and a pair of attaching pieces extending from an end portion of the tightening piece. A gap is formed between the pair of attaching pieces in which the tightening piece can be inserted. The tightening piece and attaching pieces are formed integrally by punching out a fiber surface fastener material in which a mixture of male engaging elements and female engaging elements exist on the same surface thereof.

6 Claims, 4 Drawing Sheets

BINDING BAND

BACKGROUND OF THE INVENTION

1. Field of the Invention

The present invention relates to a binding band for binding together a plurality of elongated members such as electric cords.

2. Description of the Related Art

Conventionally, a surface fastener has been used as means for holding a binding band for use for binding plural electric cords in an annular shape. For example, a binding band disclosed in Japanese Utility Model Application Laid-Open No. 63-177268 is composed by making rear faces of a male fastener piece having male engaging elements and a female fastener piece having female engaging elements face each other and attaching them together via a pair of attaching portions. Then, a holding hole is formed between the pair of the attaching portions. As for using this binding band, part of the electric cord is inserted into the holding hole of the binding band and then the other portion of the electric cord is bent several times and a main body of the binding band is wound around the folded portion of the electric cord, so that its male engaging elements and female engaging elements are engaged with each other.

A belt disclosed in Japanese Utility Model Application Laid-Open No. 5-84658 has a tape-like base body, a mixture of multiplicities of male engaging elements and female engaging elements are implanted on the same surface of this base body, and a ring is attached to an end of the base body. As for using this belt, the base body of this belt is wound once around folded electric cords such that engaging faces having the male and female engaging elements face outward. Then, an end of the base body is inserted into the ring of the belt, the base body is folded back and the engaging faces are engaged with each other so as to hold various kinds of members.

The above-mentioned conventional binding band as disclosed in Japanese Utility Model Application Laid-Open No. 63-177268 has a complicated structure and an attaching method for an electric cord is troublesome because the female surface fastener piece and male surface fastener piece have to be wound at the same time in a direction that they approach each other. In a belt disclosed in Japanese Utility Model Application Laid-Open No. 5-84658, a ring of metal or the like needs to be attached to a belt end portion and its manufacturing process is also complicated.

SUMMARY OF THE INVENTION

The present invention has been accomplished with the above-mentioned conventional problems in view, and it is an object of the invention to provide a binding band in which production thereof is simple with low cost and which is fit securely.

To achieve the above object, the present invention provides a binding band comprising a strip of tightening piece, a pair of attaching pieces which is formed on an end portion of the tightening piece and positioned substantially parallel to a longitudinal direction of the tightening piece and a gap formed between the pair of the attaching pieces in which the tightening piece can be inserted. Surface fastener engaging faces having a mixture of multiplicities of male engaging elements and female engaging elements are provided on same surfaces of the tightening piece and the attaching pieces. A connecting portion for connecting the attaching pieces to each other is provided at a front end of the attaching pieces.

The tightening piece and attaching pieces are formed integrally by punching out a fiber surface fastener material containing a mixture of multiplicities of male engaging elements and female engaging elements on a single surface.

This binding band is used for binding together elongated members such as electric cords. The attaching pieces of the binding band are attached to part of the elongated member such that they are folded back and then the tightening piece is wound around plural elongated members. At this time, the tightening piece is wound such that the surface fastener engaging face faces outward. Then, an end of the tightening piece is inserted inside the elongated member exposed between the pair of the attaching pieces and the end of the tightening piece is folded back so as to engage the surface fastener engaging faces with each other, thereby the elongated members being bound together.

DESCRIPTION OF THE PREFERRED EMBODIMENTS

Figure 1:
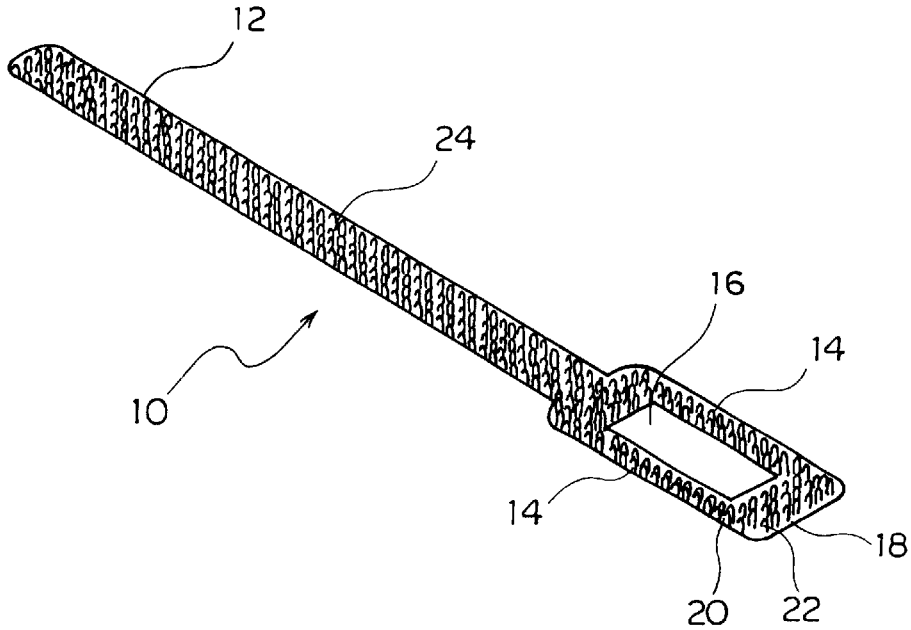
FIG. 1 is a perspective view of a binding band according to an embodiment of the present invention.

Hereinafter, the embodiment of the present invention will be described with reference to the accompanying drawings. FIGS. 1–4 show an embodiment of the present invention. A binding band 10 of this embodiment has a strip of tightening piece 12. A pair of attaching pieces 14 which are formed in a strip narrower and shorter than the tightening piece 12 are provided at an end portion of the tightening piece 12 such that they extend in an opposite direction to the extending direction of the tightening piece 12 in parallel to a longitudinal direction of the tightening piece 12. A gap 16 which is slightly wider than the tightening piece 12 is formed inside the pair of the attaching pieces 14 and a connecting portion 18 for connecting the attaching pieces 14 to each other is formed at an end of the pair of the attaching pieces 14. As a result, the attaching pieces 14 and the connecting portion 18 are provided in the shape of a square at an end of the tightening piece 12. The width of the attaching piece 14 may be equal to that of the tightening piece 12.

A mixture of hook shaped male engaging elements 20 and loop shaped female engaging elements 22 are provided substantially evenly on the surfaces of the tightening piece 12, the pair of the attaching pieces 14 and connecting portion 18 on the same side so as to form a surface fastener engaging face 24. This male engaging element 20 may be mushroom shaped.

As for producing the binding band 10 of this embodiment, using a fiber made surface fastener belt material as a base, in which a mixture of the male engaging elements 20 and the female engaging elements 22 existing on a surface is punched out integrally so as to form the tightening piece 12, attaching pieces 14 and connecting portion 18.

Figure 2:
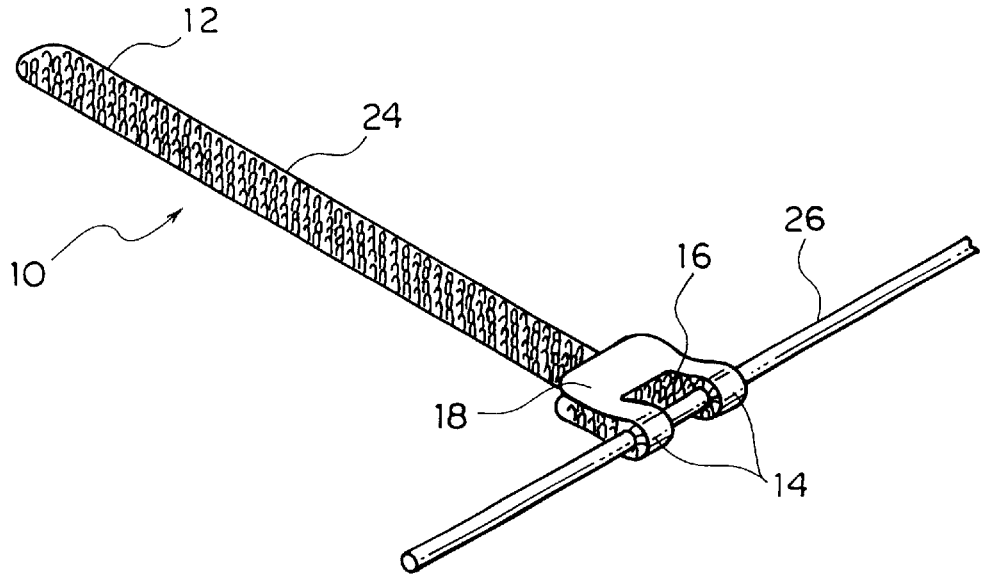
FIG. 2 is a perspective view showing a process for attaching the binding band of the embodiment.
Figure 3:
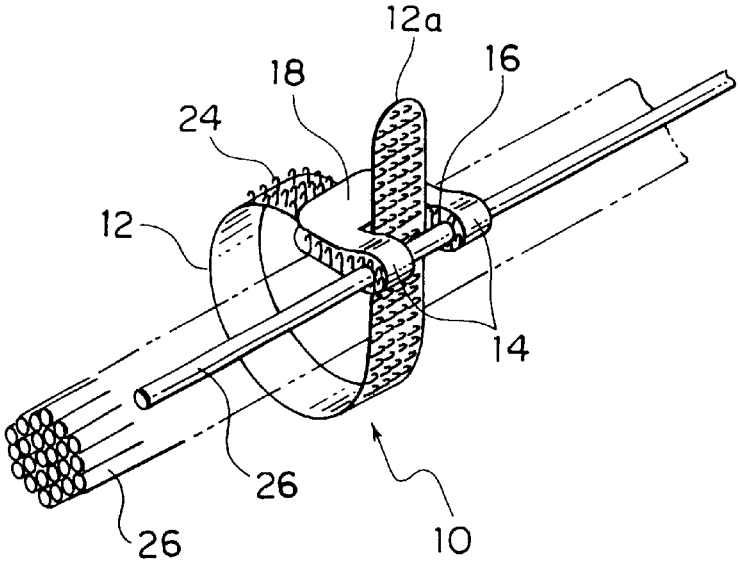
FIG. 3 is a perspective view showing a process for attaching the binding band of the embodiment.
Figure 4:
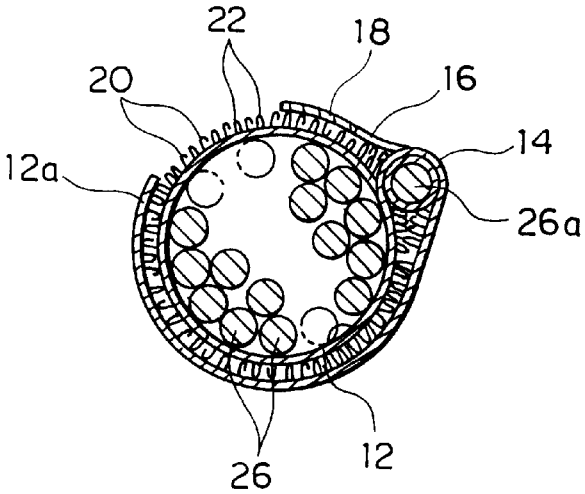
FIG. 4 is a longitudinal sectional view showing the binding band the embodiment in use.

Next, a method for using the binding band 10 of this embodiment will be described. First, as shown in FIG. 2, portions near the center of each attaching piece 14 of the binding band 10 are brought into contact with part of an elongated member 26 such as an electric cord and each of the attaching pieces 14 are folded back so as to engage the respective surface fastener engaging faces 24 with each other, thereby this binding band 10 being attached to one of the elongated members 26. At this time, the elongated member 26 to which the attaching pieces 14 are attached is exposed in the gap 16 between the attaching pieces 14 of the binding band 10. Then, the tightening piece 12 of the binding band 10 is wound once around the bunch of elongated members 26. At this time, the surface fastener engaging face 24 is faced outward. Then, as shown in FIG. 3, an end 12*a* of the tightening piece 12 of the binding band 10 is inserted inside of the elongated member 26 exposed between the gap 16 so as to make the tightening piece 12 into an annular shape. Then, the end 12*a* of the tightening piece 12 is pulled out of the gap 16 so that the annular portion is wound around the elongated members 26 tightly. The end 12*a* of the tightening piece 12 is folded back by the elongated member 26 exposed between the gap 16 and as shown in FIG. 4, the surface fastener engaging faces 24 are engaged with each other so as to bind the plural elongated members 26.

The binding band 10 of this embodiment is capable of binding together the elongated members 26 securely regardless of its simple structure. Further, engaging and disengaging of this binding band are easy and the binding band can be recycled. Because only the surface fastener engaging faces 24 are engaged or disengaged, no strong force is needed and the binding can be carried out in a short time. Further, the binding band 10 can be produced easily at a low cost. Particularly according to this embodiment, because the pair of the attaching pieces 14 are connected by the connecting portion 18, the pair of the attaching pieces 14 can be handled simultaneously with no troublesome fixing operation. Further, because an engaging area of the attaching pieces 14 corresponding to the tightening piece 12 is large, a secure and strong engagement can be achieved.

Figure 5:
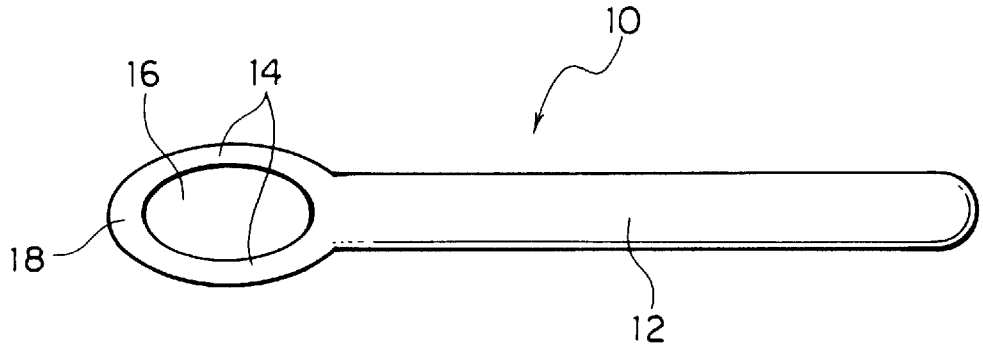
FIG. 5 is a plan view showing a modification of the binding band the present invention.

The binding band 10 of the embodiment may be of other configurations, and for example, as shown in FIG. 5, it is permissible that the pair of the attaching pieces 14 are formed in a circular shape such that its ring-like center portion is formed as the gap 16.

Figure 6:
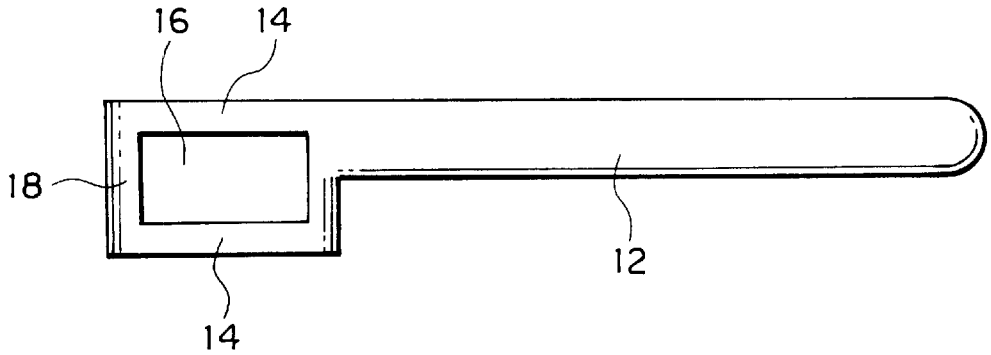
FIG. 6 is a plan view showing another modification of the binding band of the present invention.
Figure 7:
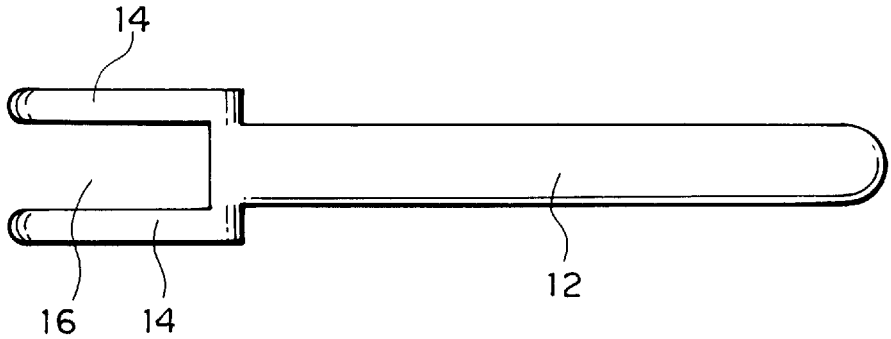
FIG. 7 is a plan view showing another modification of the binding band of the present invention.

As shown in FIG. 6, the tightening piece 12 may be located to align with a side edge portion of one attaching piece 14. Further, as shown in FIG. 7, it is permissible that the end of the attaching pieces 14 is open without any connecting portion so that the gap 16 is open.

Figure 8:
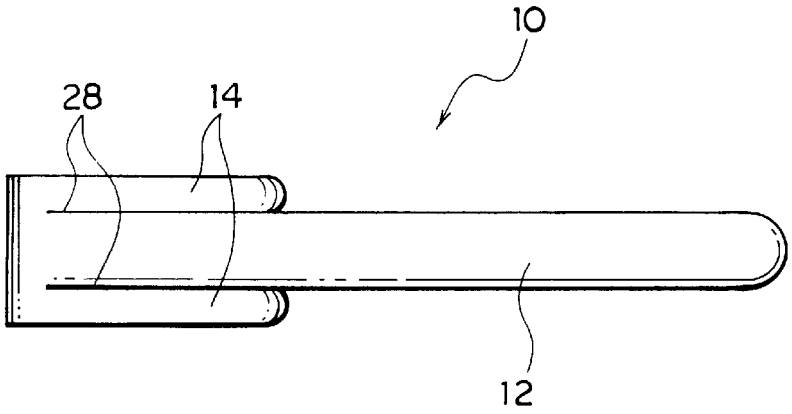
FIG. 8 is a plan view showing another modification of the binding band of the present invention.
Figure 9:
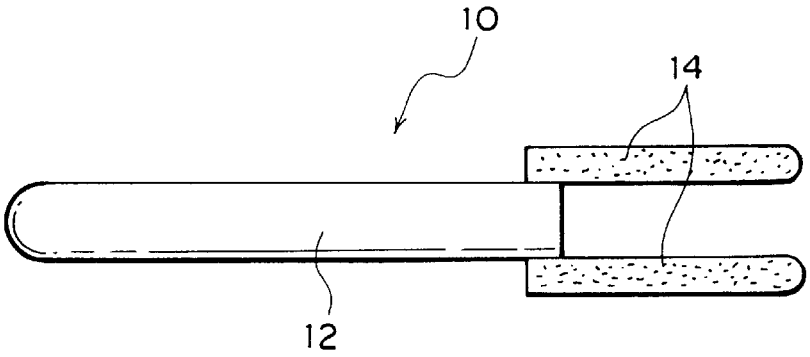
FIG. 9 is a plan view showing a process for attaching the binding band shown in FIG. 8.

Further, as shown in FIG. 8, it is permissible to provide a pair of the attaching pieces 14 near an end portion of the tightening piece 12 such that they are parallel to each other and the extending directions of the tightening piece 12 and attaching pieces 14 are the same. In this case, a cut line 28 is formed in each border line between the tightening piece 12 and attaching piece 14. As for using this binding band 10, as shown in FIG. 9, the attaching pieces 14 are folded back from end portions of the cut lines 28 to an opposite side and the attaching pieces 14 are attached by winding around part of the elongated member. Then, the tightening piece 12 is wound once around the bunch of elongated members and an end of the tightening piece 12 is inserted inside of the elongated member exposed between the pair of the attaching pieces 14. Then, the end of the tightening piece 12 is folded back so as to engage the surface fasteners with each other, thereby binding together the elongated members.

Figure 10:
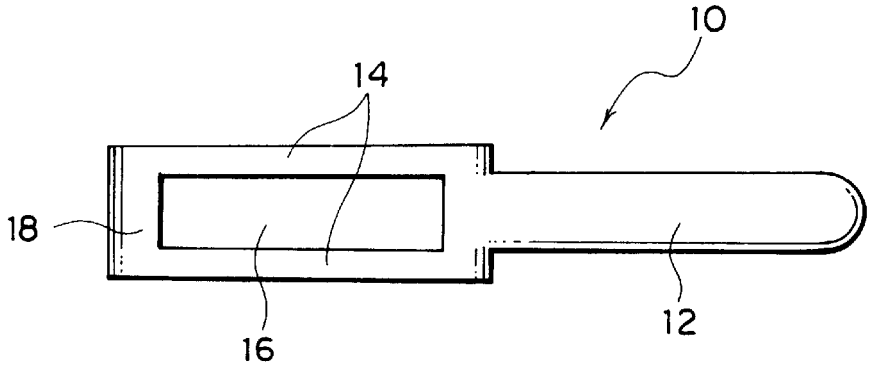
FIG. 10 is a plan view showing another modification of the binding band of the present invention.

Further, as shown in FIG. 10, it is permissible that the pair of the tightening piece 12 is formed in an equal length to the attaching pieces 14. These lengths may be set up appropriately.

The attaching pieces and the connecting portion may be of appropriate shape and may be designed freely. The binding band may be produced by any method as long as it is produced integrally from a surface fastener, and the material and structure of the surface fastener are not limited.

The binding band of the present invention is capable of binding together the elongated members such as strip members and elongated members easily and securely with a simple structure and engaging and disengaging of this band are easy. The binding procedure can be carried out in a short time without any strong force. The production method is simple with low cost.

What is claimed is:

1. A binding band comprising:

a tightening piece; and a pair of attaching pieces extending from an end portion of said tightening piece, wherein a gap is formed between the pair of said attaching pieces in which said tightening piece can be inserted, the gap having a width greater than or equal to a width wherein a surface of the tightening piece and a surface of each attaching piece have male engaging elements and female engaging elements forming a surface fastener engaging face.

2. A binding band according to claim 1, wherein said tightening piece and attaching pieces are formed integrally by punching out a fiber surface fastener material containing a mixture of multiplicities of male engaging elements and female engaging elements on a single surface thereof.

3. A binding band according to claim 1, further comprising a connecting portion at an end of the pair of said attaching pieces for connecting the attaching pieces to each other.

4. A binding band comprising:

a tightening piece; and a pair of attaching pieces comprising a first attaching piece and a second attaching piece integrally connected to the tightening piece, wherein, the pair of attaching pieces form a gap between the attaching pieces and the gap formed between the pair of said attaching pieces has a width greater than or equal to a width of the tightening piece; and a surface of the tightening piece and a surface of each of the first and second attaching pieces have male engaging elements and female engaging elements collectively forming a surface fastener engaging face on the binding band.

5. A binding band according to claim 4, further comprising a connecting piece integrally connected to the first and second attaching pieces, wherein a surface of the connecting piece has male engaging elements and female engaging elements which collectively with the surface of the tightening piece and the surface of the first and second attaching pieces forms a surface fastener engaging face on the binding band.

6. A binding band comprising:

a tightening piece; and a pair of attaching pieces comprising a first attaching piece and a second attaching piece integrally connected to the tightening piece at the first end and extending toward the second end, wherein, a surface of the tightening piece and a surface of each of the first and second attaching pieces have male engaging elements and female engaging elements collectively forming a surface fastener engaging face on the binding band.

* * * * *